United States Patent [19]

Phelan et al.

[11] Patent Number: 4,713,799

[45] Date of Patent: Dec. 15, 1987

[54] ULTRASONIC HORN WITH SIDELOBE SUPPRESSING CENTERPIECE

[75] Inventors: James J. Phelan; Larry W. Ferguson, both of Bettendorf, Iowa

[73] Assignee: Deere & Company, Moline, Ill.

[21] Appl. No.: 906,596

[22] Filed: Sep. 10, 1986

Related U.S. Application Data

[63] Continuation of Ser. No. 660,819, Oct. 15, 1984, abandoned.

[51] Int. Cl.[4] ..... H04R 1/02; G10K 11/00

[52] U.S. Cl. ..... 367/140; 367/905; 181/142; 181/185; 116/137 R

[58] Field of Search ..... 181/0.5, 139, 140, 141, 181/142, 185, 186; 367/140, 141, 142, 148, 157, 162, 165, 173, 176, 188, 191, 905; 73/632, 642; 55/276, 277; 116/137 R, 142 L, 147, DIG. 18, DIG. 19

[56] References Cited

U.S. PATENT DOCUMENTS

| | | | |
|---|---|---|---|
| 2,102,668 | 12/1937 | Ballantine | 367/162 X |
| 2,203,875 | 6/1940 | Olson | 367/140 |
| 3,292,727 | 12/1965 | Bschorr | 181/142 |
| 3,416,628 | 12/1968 | Bschorr et al. | 181/143 |
| 3,598,081 | 8/1971 | Houten | 367/140 X |
| 3,701,334 | 10/1972 | Teitelbaum | 116/137 A |
| 3,928,777 | 12/1975 | Massa | 367/152 |
| 4,104,610 | 8/1978 | Inoue et al. | 367/140 |
| 4,181,193 | 1/1980 | Isaac | 181/159 |
| 4,190,784 | 2/1980 | Massa | 310/324 |
| 4,390,078 | 6/1983 | Howze et al. | 181/185 |
| 4,433,398 | 2/1984 | Kodera et al. | 367/140 |
| 4,442,512 | 4/1984 | Kodera et al. | 367/909 |

FOREIGN PATENT DOCUMENTS

| | | |
|---|---|---|
| 246096 | 1/1924 | United Kingdom . |
| 473806 | 10/1937 | United Kingdom . |

OTHER PUBLICATIONS

Blatek Industries, Inc., 8020 Horn and Cone Unit.

*Primary Examiner*—Deborah L. Kyle
*Assistant Examiner*—Brian S. Steinberger

[57] ABSTRACT

An ultrasonic horn assembly includes a horn with a bore tapering from a throat out to a mouth. An ultrasonic transducer is mounted in the throat of the horn. A beam narrowing insert includes a headpiece which tapers smoothly from a larger diameter base to a smaller diameter top. A stem projects from the base so that the base and stem define an annular shoulder which faces the transducer. A blind bore in the stem terminates at a flat bottom surface which faces the transducer. A ring receives the transducer and webs project inwardly therefrom to support the headpiece in spaced relationship to the transducer.

11 Claims, 5 Drawing Figures

Fig. 4
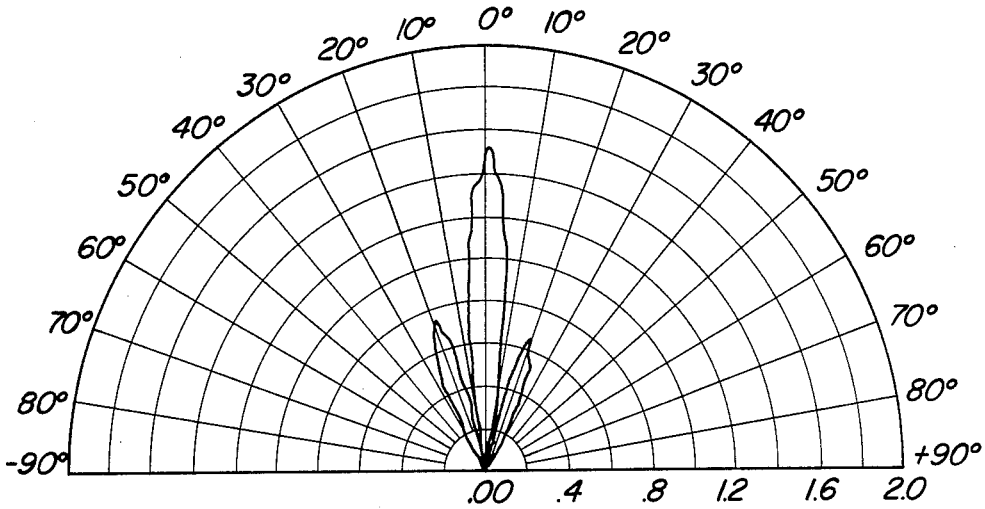
SOUND PRESSURE LEVEL (RELATIVE UNITS) VS. ANGLE FROM HORN CENTER AXIS (DEGREES) TRANSDUCER WITH HORN, BUT WITHOUT CENTERPIECE
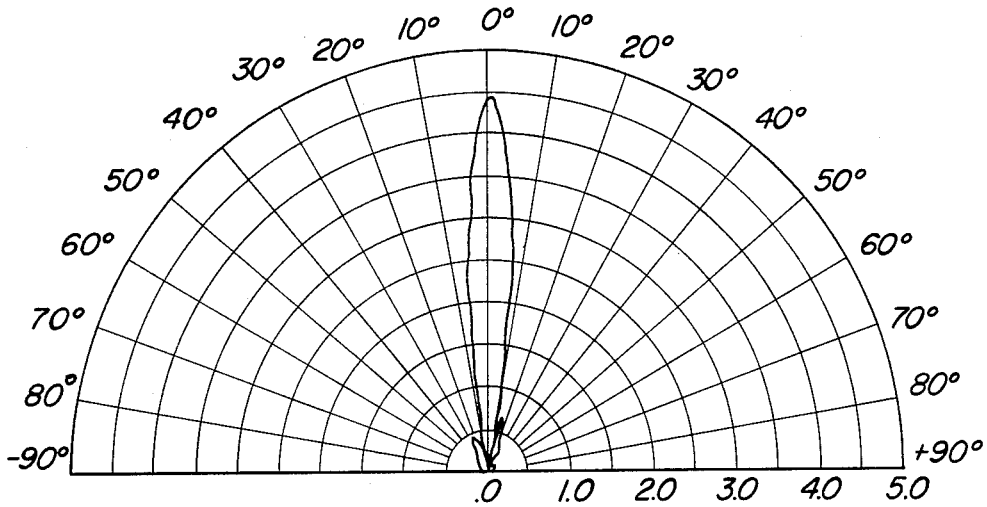
SOUND PRESSURE LEVEL (RELATIVE UNITS) VS. ANGLE FROM HORN CENTER AXIS (DEGREES) TRANSDUCER WITH HORN AND CENTERPIECE
Fig. 5

ULTRASONIC HORN WITH SIDELOBE SUPPRESSING CENTERPIECE

This application is a continuation of application Ser. No. 660,819, filed Oct. 15, 1984.

BACKGROUND OF THE INVENTION

The present invention relates to an acoustic transformer for transmitting or receiving sound in a gaseous medium. In particular, this invention improves the performance characteristic of ultrasonic frequency electroacoustic transducers.

It is known that a directed ultrasonic beam can be produced by placing a conventional ultrasonic vibrator in the throat of a horn, as shown in U.S. Pat. No. 4,433,398. Such an ultrasonic transmitter is useful in ultrasonic speed sensing systems, such as described in U.S. application, Ser. No. 609,626 (E-12676), filed May 14, 1984 and assigned to the assignee of this application. For both velocity and distance measuring applications, it is desirable to have a transmitter which produces a narrow beam. For example, in Doppler velocity measurement, a wide transmit beam can cause a noisy reflected signal in that there will be a wide frequency variation in the reflected signals. Similarly, in distance sensing, a wide transmit beam can cause reflections from non-target objects. Therefore, a narrow beam ultrasonic transmitter is desired.

SUMMARY OF THE INVENTION

An object of this invention is to provide a bending type ultrasonic transmitter or receiver with a narrow directional pattern.

This and other objects are achieved by the present invention which includes a horn and a bending type ultrasonic vibrator mounted in the throat of the horn. A centerpiece is received by a bore at the throat of the horn. The centerpiece includes a ring which receives the vibrator and a head piece which has a stem which is supported coaxially inside the ring by three webs. The head piece includes an annular shoulder surface which surrounds the stem and faces the vibrator. The stem has a blind bore therein which terminates in a flat bottom surface which also faces the vibrator. The head tapers away from the vibrator from a maximum diameter at the edge of the shoulder surface. These elements are sized and positioned so as to significantly reduce the magnitude of the ultrasonic beam secondary lobes in the directional pattern, and to also effectively increase the maximum acoustic power radiated into the atmosphere.

BRIEF DESCRIPTION OF THE DRAWINGS

FIGS. 4 and 5 are plots of ultrasonic sound pressure level v.s. angle from the horn center axis for a transducer and horn without and with, respectively, the centerpiece of the present invention.

DETAILED DESCRIPTION

Figure 1:
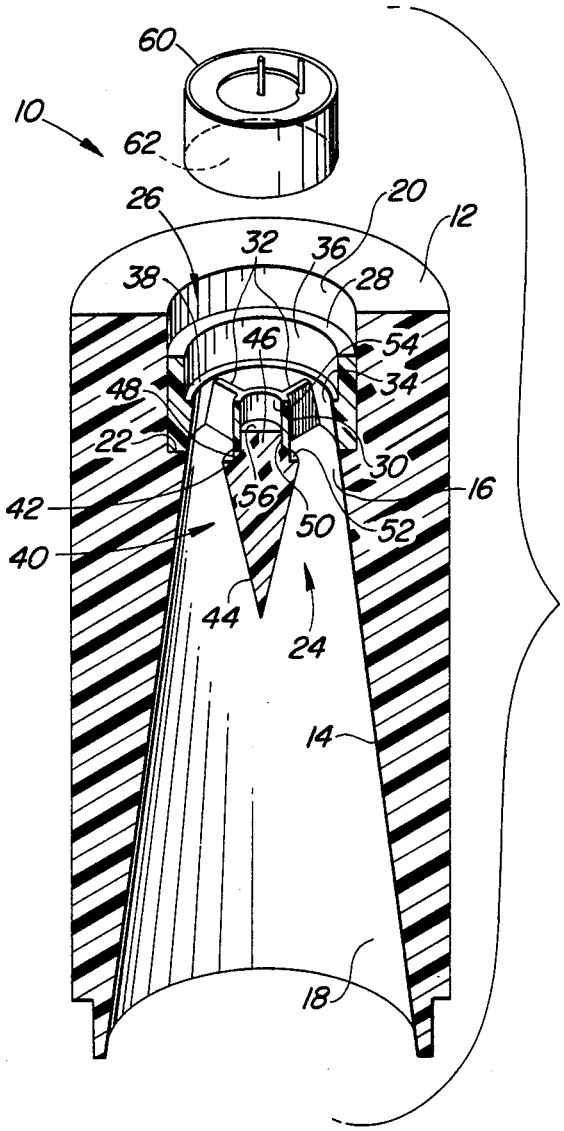
FIG. 1 is a partially exploded, partially sectioned oblique view of the present invention.

The ultrasonic horn assembly 10 includes a hollow cylindrical horn 12 with a bore 14 tapering from a smaller diameter throat portion 16 to a larger diameter mouth portion 18. A cylindrical bore 20 is joined to the throat portion of tapered bore 14 via shoulder 22.

A centerpiece or sonic barrier assembly 24 is mounted in the bore 20. Centerpiece assembly 24 includes a mounting ring 26 which has an outer ring 28 and an inner ring 30 with webs 32 extending therebetween. The webs are preferably 0.025 in. thick or substantially smaller than the ultrasonic wavelength so that they provide little interference to the ultrasonic transmissions. The outer ring 28 has a tapered bore 34 which extends partway therein and which forms an extension of the throat portion of tapered bore 14. A cylindrical bore 36 is joined to tapered bore 34 via a shoulder 38. The webs 32 project radially inwardly from the wall of the tapered bore 34.

The centerpiece assembly also includes a head 40 which tapers gradually from a larger diameter base portion 42 to a smaller diameter tip 44. A stem 46 projects from the base 42 and has larger and smaller diameter portions 48 and 50, respectively. The larger diameter portion 48 has the same diameter as that of inner ring 30. An annular shoulder 52 connects portion 48 to the base 42. Portion 50 is received by inner ring 30 so that portion 50 and inner ring 30 form a blind bore 54 with a flat bottom surface 56. The head 40 may be conically shaped, as shown, or it may taper in some other gradual or smooth manner so as to have a rounded apex, as long as it tapers from the outer edge of shoulder 52.

A conventional ultrasonic transducer, such as transmitter 60, (for example, a 40 kHz TR-89 manufactured by Massa of Hingham, Massachusetts or the SQ-40TE and SQ-40RE manufactured by Projects Unlimited) is mounted in bore 36 of outer ring 28 with the edge of its vibrating surface 62 butted against shoulder 38. Thus, vibrating surface 62 is spaced apart from inner ring 30 and webs 32 and the transmitter 60, the horn 12 and the centerpiece assembly are in coaxial alignment. A receiver could be substituted for the transmitter 60.

Although the rings 28, 30 and the head 40 are shown as separate parts, it should be understood they could just as well be formed as one single structure, thereby defining a tapered head, a stem with a blind bore from the head and an annular shoulder between the stem and head. A suitable material for the centerpiece assembly and the horn is an epoxy resin, or any other hard material, such as metal, which would reflect the ultrasonic sound waves.

Figure 2:
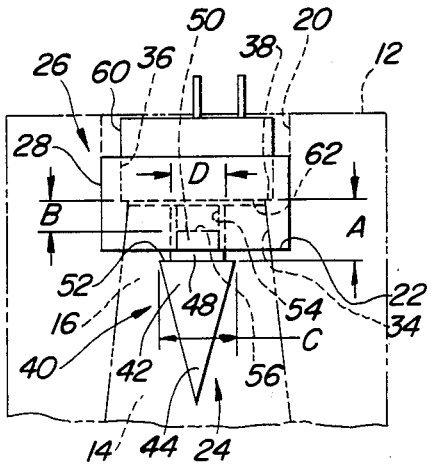
FIG. 2 is a side view assembly of FIG. 1 with portions shown in phantom.
Figure 3:
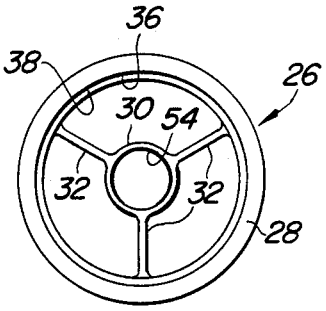
FIG. 3 is an end view of the mounting ring of the present invention, viewed from the mouth of the horn.

As best seen in FIG. 2, A represents the distance between vibrator surface 62 and the annular shoulder 52, B represents the distance between surface 62 and surface 56, C represents the outer diameter of annular, shoulder 52 and D represents the outer diameter of inner ring 30 and of large diameter stem portion 48. Optimum values for these dimensions were determined empirically and are as follows: A=0.395 in.; B=0.18 in.; C=0.475 in. and D=0.362 in. In this case, it turns out that A=1.25 L and B=0.75 L, where L is the wavelength of the ultrasonic waves. Variations in dimensions A and B appeared to have more influence than do variations in dimensions C and D.

These dimensions were determined for a horn wherein the tapered bore 14 preferably measures 3.9 in. axially and whose mouth diameter is 2.10 in. and whose throat diameter is 1.05 in. where it joins with outer ring 28. It should be understood that other dimensions would be optimal for other ultrasonic frequencies.

The horn and centerpiece assembly of FIG. 1 produce a beam of ultrasonic sound with a narrower angular spread than that which would be produced by a horn without the centerpiece. For example, FIGS. 4 and 5 are plots of measured sound pressure level (in arbitrary units) v.s. the angle from the center axis of the horn assembly. FIG. 4 illustrates the pattern of sound generated by the transducer with the horn alone. FIG. 5 illustrates the pattern of sound generated by the transducer with the horn and centerpiece assembly together. It is evident from FIGS. 4 and 5 that the addition of the centerpiece reduces the pressure level of the side lobes relative to the main or center lobe, and increasing the absolute pressure level of the main lobe, thus producing an effectively narrower ultrasonic pattern or beam.

While the invention has been described in conjunction with a specific embodiment, it is to be understood that many alternatives, modifications and variations will be apparent to those skilled in the art in light of the aforegoing description. For example, the same insert assembly would increase the directivity of an ultrasonic receiver if the transmitter 60 were replaced by an ultrasonic microphone. Accordingly, this invention is intended to embrace all such alternatives, modifications and variations which fall within the spirit and scope of the appended claims.

We claim:

1. An ultrasonic horn assembly comprising:
a horn with a tapered horn bore extending from a smaller diameter throat to a larger diameter mouth;
an ultrasonic transducer mounted in the throat;
a centerpiece comprising a headpiece having a base and a top and a stem projecting from the base, the stem and base cooperating to define an annular shoulder surface surrounding the stem and facing towards the transducer, the shoulder surface being axially spaced apart from the transducer, the stem having a blind bore extending therein which opens towards the transducer; and
means for holding the centerpiece coaxially in the horn adjacent to and spaced apart from the transducer.

2. The horn assembly of claim 1, wherein
the blind bore has a flat bottom surface.

3. The horn assembly of claim 2, wherein:
the transducer is closer to the bottom surface than to the annular shoulder surface.

4. The horn assembly of claim 2, wherein:
the transducer is spaced axially apart from the shoulder surface by approximately 1.25 L, and from the bottom surface of the blind bore by approximately 0.75 L, where L is the wavelength of the ultrasonic waves in the horn assembly.

5. The horn assembly of claim 1, wherein the means for holding comprises:
a hollow ring member which is mounted in the throat of the horn; and
a plurality of web members extending between the ring and the stem to support the headpiece coaxially in the horn.

6. The horn assembly of claim 5, wherein:
the hollow ring member coaxially receives at least a part of the transducer.

7. The horn assembly of claim 5, wherein:
the hollow ring member includes a first uniform diameter bore portion and a second tapered bore portion joined together by an annular axially facing abutment surface, the first bore portion receiving the transducer and the abutment surface engaging the transducer to maintain the transducer axially spaced apart from the stem and the webs.

8. The horn assembly of claim 7, wherein:
the tapered ring bore portion forms an extension of a wall of the tapered horn bore.

9. The horn assembly of claim 7, wherein:
the webs project radially inwardly from the second tapered bore portion of the ring.

10. An ultrasonic horn assembly comprising:
a horn with a tapered horn bore extending from a smaller diameter throat to a larger diameter mouth;
an ultrasonic transducer mounted in the throat;
a centerpiece comprising a headpiece having a base and a top and a stem projecting from the base, the stem and base cooperating to define an annular shoulder surface surrounding the stem and facing towards the transducer, the shoulder surface being axially spaced apart from the transducer, the stem having a blind bore extending therein which opens towards the transducer, the blind bore having a flat bottom surface, the transducer being spaced axially apart from the shoulder surface by approximately 1.25 L, and from the bottom surface of the blind bore by approximately 0.75 L, where L is the wavelength of the ultrasonic waves in the horn assembly; and
means for holding the centerpiece coaxially in the horn adjacent to and spaced apart from the transducer.

11. An ultrasonic horn assembly comprising:
a horn with a tapered horn bore extending from a smaller diameter throat to a larger diameter mouth;
an ultrasonic transducer mounted in the throat;
a centerpiece comprising a headpiece having a base and a top and a stem projecting from the base, the stem and base cooperating to define an annular shoulder surface surrounding the stem and facing towards the transducer, the shoulder surface being axially spaced apart from the transducer, the stem having a blind bore extending therein which opens towards the transducer; and
means for holding the centerpiece coaxially in the horn adjacent to and spaced apart from the transducer, the means for holding comprising a hollow ring member which is mounted in the throat of the horn, and a plurality of web members extending between the ring and the stem to support the headpiece coaxially in the horn, the hollow ring member including a first uniform diameter bore portion and a second tapered bore portion joined together by an annular axially facing abutment surface, the first bore portion receiving the transducer and the abutment surface engaging the transducer to maintain the transducer axially spaced apart from the stem and the webs.

* * * * *